US009107281B2

(12) United States Patent
Yamamoto et al.

(10) Patent No.: US 9,107,281 B2
(45) Date of Patent: Aug. 11, 2015

(54) DRIFT TUBE LINEAR ACCELERATOR

(71) Applicant: Mitsubishi Electric Corporation, Chiyoda-ku (JP)

(72) Inventors: Kazuo Yamamoto, Chiyoda-ku (JP); Nobuyuki Haruna, Chiyoda-ku (JP); Takahisa Nagayama, Chiyoda-ku (JP); Hiromitsu Inoue, Chiyoda-ku (JP); Takayuki Kashima, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 274 days.

(21) Appl. No.: 13/894,664

(22) Filed: May 15, 2013

(65) Prior Publication Data

US 2013/0328506 A1 Dec. 12, 2013

(30) Foreign Application Priority Data

Jun. 12, 2012 (JP) ..... 2012-132522
Nov. 29, 2012 (JP) ..... 2012-260545

(51) Int. Cl.
*H05H 9/00* (2006.01)
*H05H 7/22* (2006.01)

(52) U.S. Cl.
CPC ..... *H05H 7/22* (2013.01)

(58) Field of Classification Search
CPC ..... H05H 9/00; H05H 7/02; H05H 7/18; H05H 9/04; H05H 7/00
USPC ..... 315/500–505
See application file for complete search history.

(56) References Cited

U.S. PATENT DOCUMENTS

| | | | | |
|---|---|---|---|---|
| 7,868,564 | B2 | 1/2011 | Iwata et al. | |
| 2009/0302785 | A1 * | 12/2009 | Miller et al. | 315/505 |
| 2010/0301782 | A1 * | 12/2010 | Yamamoto et al. | 315/505 |

FOREIGN PATENT DOCUMENTS

| | | | |
|---|---|---|---|
| JP | 2005/50646 | | 2/2005 |
| JP | 2006-234797 | | 9/2006 |
| JP | 2007-157400 | | 6/2007 |
| JP | 4194105 | | 10/2008 |
| JP | 2011-86494 | | 4/2011 |
| JP | 2011096389 | A * | 5/2011 |

* cited by examiner

*Primary Examiner* — Quan Tra
(74) *Attorney, Agent, or Firm* — Oblon, McClelland, Maier & Neustadt, L.L.P.

(57) ABSTRACT

According to the drift tube linear accelerator of the invention, its acceleration cavity is configured with a center plate and a pair of half cylindrical tubes, wherein the center plate includes a ridge, stems connecting the ridge and drift tube electrodes, and the drift tube electrodes, and wherein the acceleration cavity is configured, as seen in cross section perpendicular to a beam-acceleration center axis, whose inner diameter in X-direction that is perpendicular to a central axis in planar direction in which the stem of the center plate extends and that is passing through the beam-acceleration center axis, is longer than whose inner diameter in Y-direction parallel to the central axis in planar direction.

18 Claims, 18 Drawing Sheets

DRIFT TUBE LINEAR ACCELERATOR

BACKGROUND OF THE INVENTION

1. Field of the Invention

The present invention relates to a drift tube linear accelerator for accelerating charged particles, such as protons or heavy particles.

2. Description of the Background Art

In order to accelerate charged particles, such as protons or heavy particles to high energy, a synchrotron is utilized. In the synchrotron, an injector for pre-acceleration is used. Typically, the injector is configured with an ion source, a pre-accelerator and a post-accelerator. As the post-accelerator, a drift tube linear accelerator is applied.

The drift tube linear accelerator is configured with an acceleration cavity in which several or several tens of electrodes called as drift tubes are arranged in one direction of an acceleration-beam axis. The acceleration cavity is a resonator having a resonance frequency. When high-frequency power corresponding to the resonance frequency of the acceleration cavity is supplied to the acceleration cavity, a high-frequency electric field is generated between the drift tube electrodes. Charged particles such as protons entered into the acceleration cavity are accelerated by receiving energy from the high-frequency electric field generated between the drift tube electrodes. When, due to time-wise (phase) variation of the high-frequency electric field, the electric field is generated in reverse direction against the accelerating direction, the charged particles are decelerated. Thus, the arrangement of the drift tube electrodes is so designed that the charged particles are to be accelerated. That is, the arrangement of the drift tube electrodes is designed such that the charged particles stay in between the drift tube electrodes when an accelerating electric field is generated, whereas the charges particles stay in the drift tube electrodes when a decelerating electric field is generated, so as to avoid adverse effect by the generated electric field.

Examples in structure of the drift tube linear accelerator include an Alvarez-type linear accelerator and an IH (Interdigital-H)-type linear accelerator. The Alvarez-type linear accelerator is characterized by its $2\pi$-mode acceleration in which the phase goes by 360 degree from a center between drift tube electrodes to next center between drift tube electrodes. Thus, the drift tube electrodes have a sufficient length to allow divergence of the charged particles. Therefore, in order to prevent the divergence of the charged particles, a focusing device such as quadrupole electrode, etc., for suppressing the divergence of the charged particles is generally disposed in the drift tube electrode. Consequently, as an injector for accelerating charged particles that are light in mass and to be easily diverged, such as protons, the Alvarez-type accelerator that allows the addition of quadrupole electrode, etc., is adopted.

In contrast, the IH-type linear accelerator is characterized by its n-mode acceleration in which the phase goes by 180 degree from a center between drift tube electrodes to next center between drift tube electrodes. Thus, the IH-type linear accelerator achieves an acceleration frequency that is made twice that of the Alvarez-type linear accelerator, so that the whole length of the drift tube electrode can be shorter than that of the Alvarez-type linear accelerator; however, when the whole length is short, it is difficult to dispose the focusing device such as quadrupole electrode, etc., in the drift tube electrode in order to prevent the divergence of the charged particles. Consequently, as an injector for accelerating charged particles that are heavy in mass and not to be easily diverged, such as carbon ions, the IH-type accelerator is adopted also because the whole length can be short.

The injector is a device for preliminarily accelerating the particles to the energy receivable by the synchrotron, and thus it is necessary to satisfy the requirements by the synchrotron for reception. In particular, not only the energy but also its difference between the charged particles (referred to as "momentum spread") is required to fall within a specified range. In this instance, in order to achieve a planned accelerating electric-field distribution, the drift tube linear accelerator is finely adjusted after its fabrication in its resonance frequency and accelerating electric-field distribution by adjusting the insertion amount of external tuner blocks composed of from several to several tens blocks and inserted in the acceleration cavity (For example, Patent Document 1 and Patent Document 2).

Patent Document 1: Japanese Patent Application Laid-open No. 2007-157400 (FIG. 1)

Patent Document 2: Japanese Patent No. 4194105 (FIGS. 1-3)

An amount of high frequency power to be supplied to the acceleration cavity for generating the accelerating electric field, is determined by power consumption in the acceleration cavity and an amount of beam loading. The power consumption in the acceleration cavity is categorized into that due to a surface resistance and that due to a contact resistance, in the acceleration cavity. Generally, assuming that the power consumption due to the surface resistance is a value of 1, the power consumption due to the surface resistance and the contact resistance in combination is represented as 100/80 to 100/60. Accordingly, an increase of the number of devices in the acceleration cavity that produce a contact resistance, causes an increase in power consumption in the acceleration cavity, resulting in increase of a capacity of the high frequency power source that generates high frequency power to be supplied to the acceleration cavity. Thus, in the case of using a drift tube linear accelerator as the injector of a synchrotron, if a large number of external tuners are disposed as in the conventional art according to the necessity to highly accurately adjust the resonance frequency and the accelerating electric-field distribution, the power consumption due to the surface resistance and the contact resistance in combination is more increased, resulting in a problem that the capacity of the high frequency power source becomes increased.

SUMMARY OF THE INVENTION

The present invention has been made to solve the above problem, and an object thereof is to provide a drift tube linear accelerator for use in the injector, which is even an IH-type, but can achieve power saving by not providing an external tuner.

A drift tube linear accelerator of the invention is characterized in that, its acceleration cavity in which a drift tube electrode and another drift tube electrode are arranged is formed of a center plate and a pair of half cylindrical tubes; the center plate includes a ridge, stems and the drift tube electrodes, each stem connecting the ridge and the drift tube electrode, which are made from a common block; and the acceleration cavity is configured, as seen in cross section perpendicular to a beam-acceleration center axis, whose inner diameter in X-direction that is perpendicular to a central axis in planar direction in which the stem of the center plate extends and that is passing through the beam-acceleration center axis, is longer than whose inner diameter in Y-direction parallel to the central axis in planar direction.

According to the drift tube linear accelerator of the invention, its acceleration cavity is configured with the center plate and the pair of half cylindrical tubes, and the pair of half cylindrical tubes are machined so that, as seen in cross section perpendicular to the beam-acceleration center axis, the inner diameter in X-direction of the acceleration cavity is made longer than the inner diameter in Y-direction of the acceleration cavity, to thereby adjust the resonance frequency and the accelerating electric-field distribution of the acceleration cavity. Thus, the drift tube linear accelerator can, even being an IH-type, achieve power saving by not providing an external tuner.

The foregoing and other objects, features, aspects and advantages of the present invention will become more apparent from the following detailed description of the embodiments and the accompanying drawings.

DETAILED DESCRIPTION OF THE INVENTION

Embodiment 1

Figure 1:
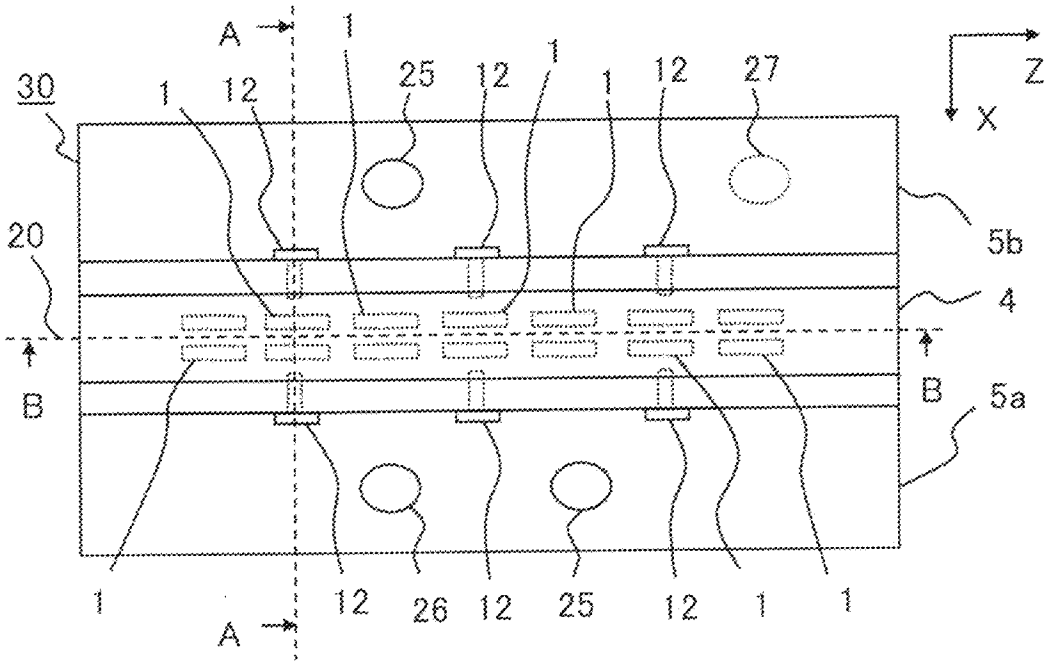
FIG. 1 is a configuration diagram of a drift tube linear accelerator according to Embodiment 1 of the invention.
Figure 2:
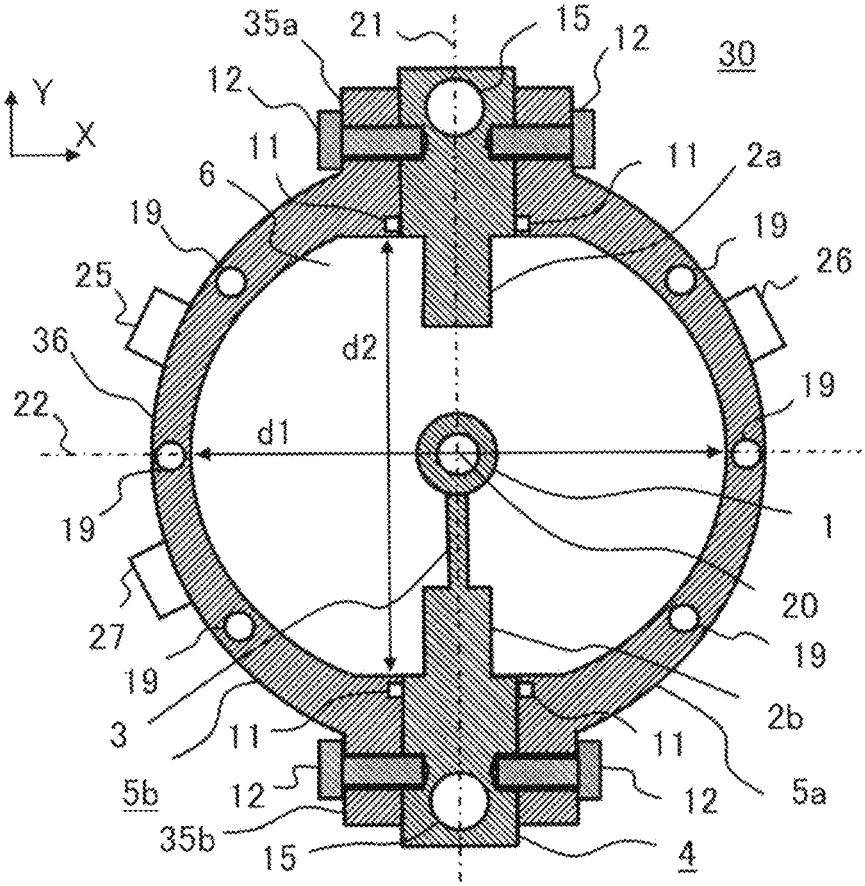
FIG. 2 is a transverse cross-sectional view taken along A-A line in FIG. 1.
Figure 3:
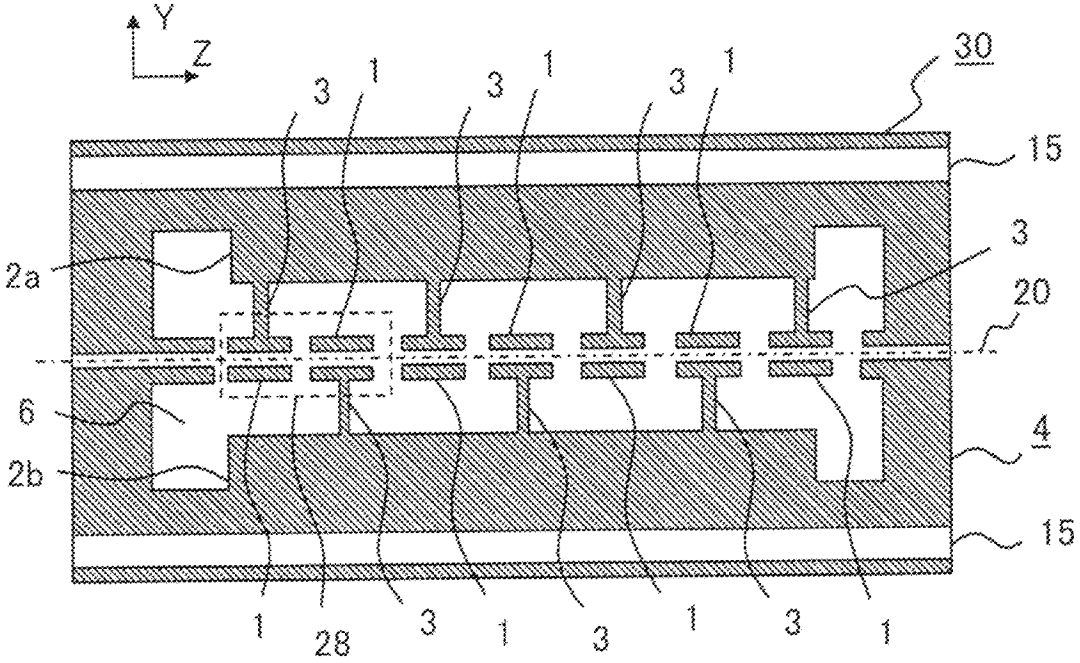
FIG. 3 is a longitudinal cross-sectional view taken along B-B line in FIG. 1.

FIG. 1 is a configuration diagram of a drift tube linear accelerator according to Embodiment 1 of the invention. FIG. 2 is a transverse cross-sectional view taken along A-A line in FIG. 1, and FIG. 3 is a longitudinal cross-sectional view taken along B-B line in FIG. 1. The drift tube linear accelerator 30 includes, at least one pair of, that is, two or more of drift tube electrodes 1 arranged in a direction of an acceleration-beam axis; two half cylindrical tubes 5*a*, 5*b* and a center plate 4 which constitute an acceleration cavity 6; a power supply port 25, a power measurement port 26 and a vacuum evacuation port 27. The drift tube electrode 1 is positioned above a basement, called as a ridge 2, for an accelerating electric field to be uniformly generated all over the acceleration cavity, through the pillar-shaped stem 3, so as to enclose a beam-acceleration center axis 20. A pair of drift tube electrodes 28 is composed of the drift tube electrode 1 and the other drift tube electrode 1 adjacent thereto. Shown in FIG. 2 and FIG. 3 is a case where a ridge 2*a* is provided on the upper side and a ridge 2*b* is provided on the lower side. Note that, with respect to the ridge, reference numeral "2" is used collectively, and "2*a*" and "2*b*" are used for individual description. Also, as to the half cylindrical tube, reference numeral "5" is used collectively, and "5*a*" and "5*b*" are used for individual description.

The drift tube electrodes 1 are so fabricated not to cause an electrode-to-electrode difference in their positions relative to the ridge 2. In Embodiment 1, the ridge 2 and the stem 3 as well as the drift tube electrodes 1 are fabricated, as the center plate 4, by cut-out from a block made of same material. The acceleration cavity 6 is formed by sandwiching the center plate 4 by the pair of half cylindrical tubes 5*a*, 5*b*. The half cylindrical tubes 5 each include two joining portions 35*a*, 35*b* joined to the center plate 4, and a body portion 36 connecting the two joining portions 35*a*,36*b*. In FIG. 2, the joining portions 35*a*, 35*b* and the body portion 36 are referenced for the half cylindrical tube 5*b*.

In that configuration, the center plate 4 may be in standing state as sandwiched from the right and left sides or in lying state as sandwiched from upper and lower sides, by the half cylindrical tubes 5*a*,5*b*. In Embodiment 1, description is made for a case where the center plate 4 is in standing configuration with the half cylindrical tubes 5*a*, 5*b* sandwiching it from the right and left sides, in order to avoid that a difference between a central axis of the drift tube electrodes 1 and a central axis of the acceleration cavity 6 occurs due to warping of the stem 3 by the weight of the drift tube electrodes 1 themselves. Further, the pair of half cylindrical tubes 5*a*, 5*b* are preferably symmetric to each other, but they are not necessarily symmetric. Further, it is preferable that the pair of half cylindrical tubes 5*a*, 5*b* be fabricated each by grinding down a block of aluminum, iron, stainless steel or the like.

Here, coordinate axes are defined. A direction in which the drift tube electrodes 1 are arranged is referred to as an acceleration-beam axis (Z-axis). A standing direction of the center plate 4 (width direction of the center plate 4; vertical direction in FIG. 2 and FIG. 3) is defined as Y-axis, and a mounting direction of the pair of half cylindrical tubes 5*a*, 5*b* to the center plate 4 from the right and left sides (thickness direction of the center plate 4; vertical direction in FIG. 1 and lateral direction in FIG. 2) is defined as X-axis. In FIG. 2, a central axis 21 is a central axis in planar direction 21 of the center plate 4, and another central axis 22 is a central axis in plate-thickness direction 22 of the center plate 4. The central axis in planar direction 21 is a central axis that extends in +Y direction and −Y direction from the beam-acceleration center axis 20 of the acceleration cavity 6, and the central axis in plate-thickness direction 22 is a central axis that extends in +X direction and −X direction from the beam-acceleration center axis 20 of the acceleration cavity 6.

As shown in FIG. 2, the acceleration cavity 6 is configured, as seen in cross section perpendicular to the beam-acceleration center axis 20, whose inner diameter d1 in X-direction that is perpendicular to the central axis in planar direction 21 in which the stem 3 of the center plate 4 extends and that is passing through the beam-acceleration center axis 20, is longer than whose inner diameter d2 in Y-direction parallel to the central axis in planar direction 21.

Figure 4:
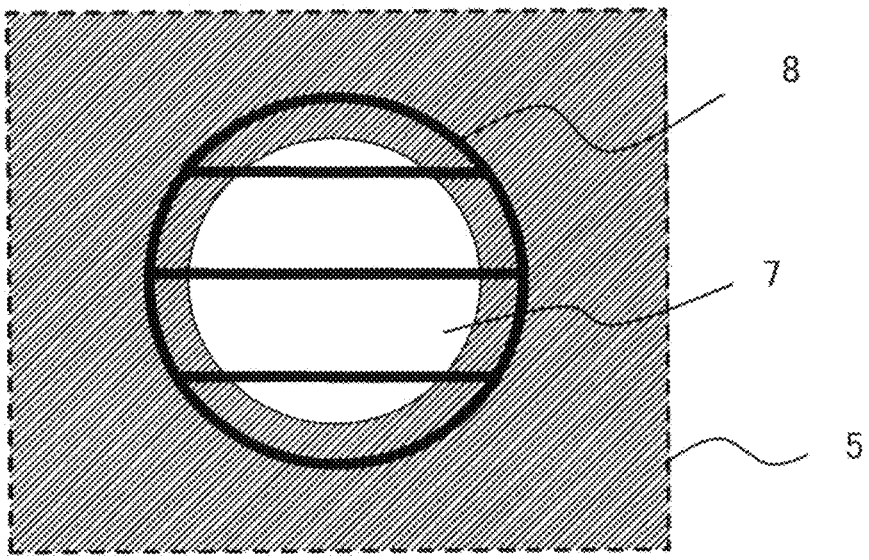
FIG. 4 is a diagram showing vacuum an evacuation hole at a portion where the vacuum evacuation port is to be formed in FIG. 1.

The half cylindrical tubes 5 are provided with at least one power supply port 25 for supplying power, at least one power measurement port 26 that is a port for mounting a pick-up antenna to measure power supplied to the acceleration cavity 6, and at least one vacuum evacuation port 27 for vacuum-evacuating the acceleration cavity 6. In FIG. 1, a case is illustrated where there are two power supply ports 25 and each one of power measurement port 26 and vacuum evacuation port 27. To the vacuum evacuation port 27, it is preferable to provide a metal mesh (usually, called as RF mesh 8) in order to prevent an electromagnetic field generated in the acceleration cavity 6 from leaking into the port. Shown in FIG. 4 are a vacuum evacuation hole 7 of the vacuum evacuation port 27 and an RF mesh 8 that are provided on the half cylindrical tube 5. There is another case without providing the separate RF mesh where a portion corresponding to the metal mesh is formed also by grind-down from the single block.

Figure 5:
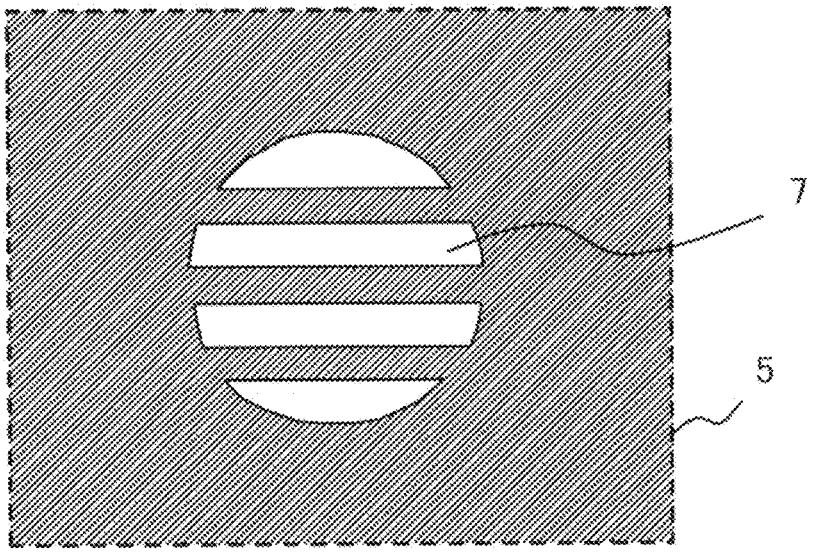
FIG. 5 is a diagram showing another vacuum evacuation hole at the portion where the vacuum evacuation port is to be formed in FIG. 1.
Figure 6:
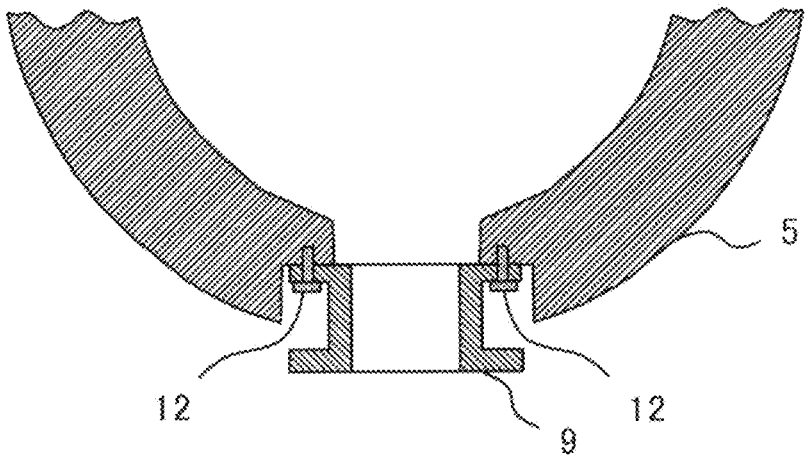
FIG. 6 is a diagram showing a mounting configuration of a port of the invention.

In FIG. 5, a vacuum evacuation hole 7 of the vacuum evacuation port 27 with a portion corresponding to the metal mesh and having been formed by grind-down from the single block, is shown. The vacuum evacuation hole 7 shown in FIG. 5 is formed of a plurality of slits. Meanwhile, each port duct of the power supply ports 25, the power measurement port 26 and the vacuum evacuation port 27 is, instead of being welded to the half cylindrical tube 5, preferably fastened by screw thereto through an RF contact. In FIG. 6, an example of the port duct 9 fastened by screw is shown. Each port duct 9 of the power supply ports 25, the power measurement port 26 and the vacuum evacuation port 27 is fastened to the half cylinder tube 5 by using screws 12.

Figure 7:
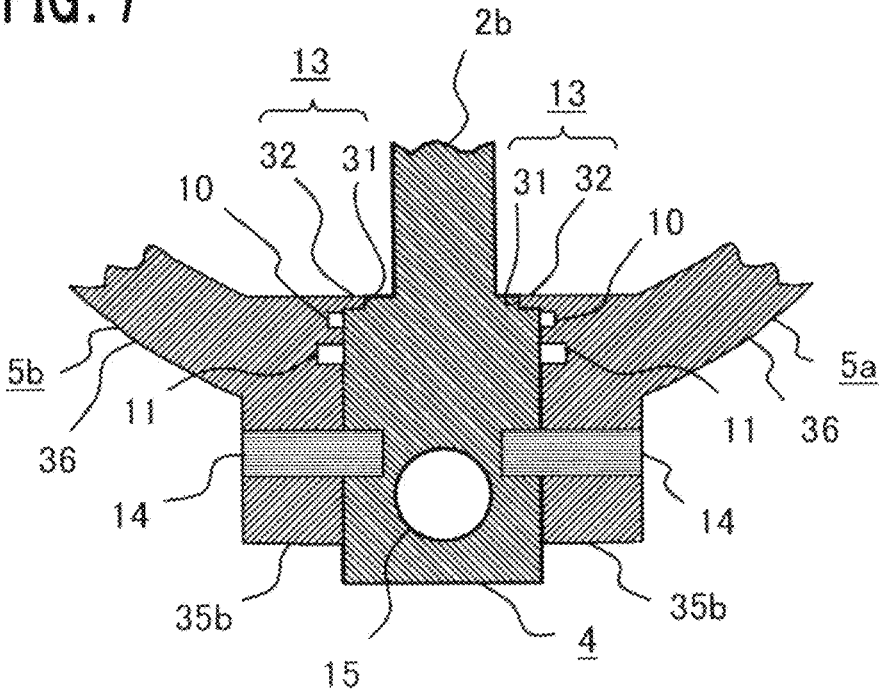
FIG. 7 is a diagram showing a joining portion of a center plate and a half cylindrical tube of the invention.

The connection of the center plate 4 with the pair of half cylinder tubes 5*a*, 5*b* will be described. FIG. 7 is a diagram showing a joining portion of the center plate and the half cylindrical tubes of the invention. The center plate 4 and the pair of half cylinder tubes 5*a*, 5*b* are fastened together by plural screws 12 (see, FIG. 1 and FIG. 2) through an RF contact 10 and an O-ring 11 for vacuum-sealing. Mutual positions of joining faces of the center plate 4 and the pair of half cylinder tubes 5*a*, 5*b*, are determined byway of engaging portions 13 and pins 14. For example, concave portions 31 are formed on the center plate 4 and convex portions 32 are formed on the half cylindrical tubes 5. The concave portions 31 of the center plate 4 and the convex portions 32 of the half cylindrical tubes 5 constitute the engaging portions 13 in mutual engagement, that is, an engaging structure.

In the center plate 4, cooling paths 15 for water-cooling are bored at its both fringe portions, not at the portion of the ridge 2. Likewise, in the half cylindrical tubes 5, cooling paths 19 are bored at their thick-walled portions (see, FIG. 2). In FIG. 2, a case is illustrated where two cooling paths 15 are formed in the center plate 4 and three cooling paths 19 are formed in each of the half cylindrical tubes 5*a*, 5*b*.

A manufacturing method of the drift tube linear accelerator 30 will be described. First, the center plate 4 is fabricated by cutting out the portion other than the drift tube electrode 1, the stem 3 and the ridge 2 from one plate block, so as to leave the drift tube electrode 1, the stem 3 and the ridge 2. In particular, since positional accuracy is strictly required for the drift tube electrode 1, an NC (Numerical Control) machining is used to ensure the positional accuracy and its repeatability in remanufacturing. Generally, a positional tolerance in Z-axis direction of the drift tube electrode 1 is ±0.1 mm, which is sufficiently larger than the machining accuracy of an NC machine. Next, the half cylindrical tube 5 is fabricated by grind-down machining from a single block. In this machining, at the port location, the wall face for the port is partially left correspondingly to the RF mesh 8, as shown in FIG. 5. Further, as shown in FIG. 6, the port duct is configured to be mounted by screw, not by welding. As shown in FIG. 7, on the joining faces of the center plate 4 and the pair of half cylinder tubes 5*a*, 5*b*, the concave portions 31 of the center plate 4 and the convex portions 32 of the half cylindrical tubes 5 are engaged, respectively. The center plate 4 and the half cylindrical tubes 5*a*, 5*b* are, after determined their positions by the pins 14, fastened together by the screws 12 through the RF contact 10 and the O-ring 11. In this way, the acceleration cavity 6 is formed by joining the center plate 4 and the half cylindrical tubes 5*a*, 5*b* together.

After the formation of the acceleration cavity 6, an electric-field distribution and a resonance frequency produced between the drift tube electrodes 1 are measured using a perturbation method or the like. Also, the electric-field distribution produced between the drift tube electrodes 1, is integrated from the center of the drift tube electrode 1 and to the center of the other drift tube electrode 1 to calculate a voltage therebetween. Then, the voltage developed between the drift tube electrodes 1 and the resonance frequency of the acceleration tube 6 are compared to their planned values. Conventionally, in order to match the measured values and the planned values by removing their difference, external tuners are used. In this embodiment, a configuration for achieving a tuner-less structure will be described below.

The resonance frequency and electric-field distribution of the acceleration cavity 6 are determined mainly by an electrostatic capacitance C between the drift tube electrodes 1 themselves and an inductance L in the acceleration cavity 6. A relational expression related to the resonance frequency F is shown as a formula (1).

$$F = \frac{1}{2\pi\sqrt{LC}} \tag{1}$$

An inductance L is proportional to a magnetic flux that is produced by a current flowing through a coil and that is crossing the coil, and to the current, and its proportional constant is called as a self-inductance; this relational expression can be applied to the acceleration cavity 6. Namely, the relationship among, an orthogonally crossing area S of the magnetic flux (corresponding to the cross-sectional area of the acceleration cavity 6); a magnetic flux density B; and a current I flowing on the inner wall of the acceleration cavity 6, is represented by a formula (2).

$$L = B \cdot S / I \tag{2}$$

Since there are structural objects such as the drift tube electrodes 1 etc., in the acceleration cavity 6, it may be difficult to exactly determine the relational expression about the formula (2); however, the basic concept therefor may not be changed. Namely, enlarging the inner diameter of the acceleration cavity 6 makes the area S larger, and thus the inductance L larger according to the formula (2). As a result, the resonance frequency F of the acceleration cavity 6 becomes smaller according to the formula (1).

Further, a relational expression for an electrostatic capacitance between parallel plate conductors is applicable for the electrostatic capacitance C. Namely, assuming that a cross-sectional area of the drift tube electrode 1 orthogonal to Z-axis is represented by "s", a gap between the drift tube electrode 1 and the adjacent drift tube electrode 1 is represented by "d", and a dielectric constant is represented by "∈", the relational expression of a formula (3) is established.

$$C=\in\cdot s/d \tag{3}$$

Thus, enlarging the cross-sectional area s of the drift tube electrode 1 makes the electrostatic capacitance C larger according to the formula (3). As a result, the resonance frequency F of the acceleration cavity 6 becomes smaller according to the formula (1). Next, a relational expression of an intensity of the electric field generated between the drift tube electrodes 1 is shown as a formula (4).

$$\int_c E\cdot dl = -\int_S \dot{B}\cdot dS \tag{4}$$

In the formula, "B" represents the magnetic flux density in the acceleration cavity 6, and the dot given on "B" in the formula (4) represents time differentiation. "S" represents the cross-sectional area of the acceleration cavity. Further, the left-hand side of the formula (4) corresponds to the voltage generated between the drift tube electrode 1 and the other drift tube electrode 1 in the pair of drift tube electrodes 28, and the right-hand side corresponds to a timewise variation of the magnetic field in the cross-sectional area S at the voltage-generated region of the acceleration cavity 6.

Thus, enlarging the inner diameter of the acceleration cavity 6 makes the right-hand side of the formula (4) larger, so that the left-hand side of the formula (4), that is, the voltage generated between the drift tube electrode 1 and the other drift tube electrode 1 is increased.

The acceleration cavity 6 in Embodiment 1 has a structure for adjusting the inductance L. A method of adjusting the inductance L is described below. Firstly, a way to match the electric-field distribution with its planned values will be described.

In the case of enhancing the intensity of the electric field generated between the drift tube electrode 1 and the other drift tube electrode 1 in a given pair of drift tube electrodes 28, the inner diameter of the half cylindrical tubes 5 at the position "z" in the Z-direction located in between (gap) the drift tube electrode 1 and the other drift tube electrode 1, is enlarged according to the formula (4). In this instance, since the half cylindrical tube 5 has structures in Y-axis direction to be engaged with the center plate 4, its shape is machined with respect to X-axis direction, without being machined with respect to Y-axis direction. Regarding the intensity of the electric field generated in the acceleration cavity 6, if the inner diameter of the acceleration cavity 6 in its beam-incident side is enlarged, for example, only in X-axis direction by the way aforementioned in order to enhance the electric field intensity in the incident side, the electric field intensity in its beam-emitting side is decreased inversely. At the same time, the resonance frequency F becomes decreased according to the formula (1), due to the enlargement of the inner diameter of the half cylindrical tubes 5 in its beam-incident side. Thus, the shape of inner wall of the half cylindrical tubes 5 has been determined at the design stage so that the resonance frequency is made higher than the planned resonance frequency. Then, the inner wall of the half cylindrical tubes 5 is grinded into an elliptical shape so that the inner diameter is enlarged only in the direction of X-axis, according to the actual measurement value.

Figure 8:
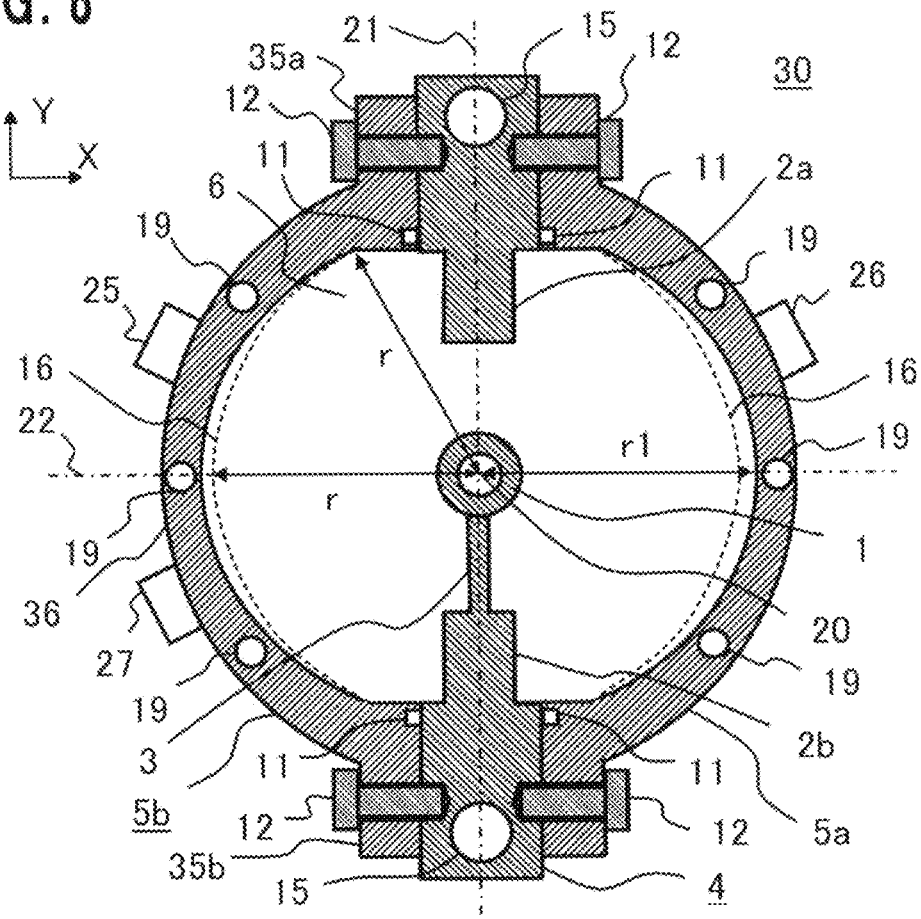
FIG. 8 is a diagram showing states of half cylindrical tubes after and before machining.

In FIG. 8, states of the acceleration cavity 6 after and before grinding the inner walls of the half cylindrical tubes 5 into an elliptical shape are shown. An inner wall 16 of each half cylindrical tube 5 indicated by a broken line represents the inner wall of the half cylindrical tube 5 before the matching of the electric-field distribution. Each half cylindrical tube 5 indicated by a solid line represents its state after such machining. In the half cylindrical tube 5 before the machining, the dimension is "r" from the beam-acceleration center axis 20 to the inner wall of the body portion 36, other than to the joining portions 35*a*,35*b* having engaging structures to the center plate 4 of the half cylindrical tube 5. After the machining, the dimension is "r" from the beam-acceleration center axis 20 to the inner wall at the boundary of the joining portions 35*a*,35*b* and the body portion 36 of the half cylindrical tube 5; however, in the direction of X-axis, the dimension from the beam-acceleration center axis 20 to the inner wall of the half cylindrical tube 5 is "r1" which is longer than "r". That is, the shape of the body portions 36 of the half cylindrical tubes 5 after the machining becomes an elliptical shape having the dimension "r1" from the beam-acceleration center axis 20 to the inner wall, which has been changed from "r", and having the dimension "r" as returned therefrom.

Thus, for machining the half cylindrical tubes 5, it is necessary to use an NC machine which is limited in its machinable whole length. Accordingly, it is preferable not to adopt an Alvarez-type linear accelerator, but to adopt an IH-type linear accelerator with a shorter whole length. Further, in order to be machined by the NC machine, it is structurally preferable that the acceleration cavity 6 be formed using two half cylindrical tubes 5, not using a cylindrical tube for forming the acceleration cavity 6 by inserting the center plate 4 into the center of the tube. Furthermore, in order to be machined by the NC machine, it is preferable that the port ducts 9 be mounted to the half cylindrical tubes 5 not by welding, but by screws that allow the ducts to be detached at the time of machining by the NC machine. By forming the acceleration cavity 6 with the half cylindrical tubes 5 and the center plate 4, it becomes possible to adjust the electric-field distribution without using the external tuner.

First, using the NC machine, the inner shape of the half cylindrical tubes 5 are machined as described above to be elliptical so that the inner diameter is enlarged only in the direction of X-axis thereby matching the electric-field distribution with the planned values. Here is assumed that the electric-field distribution is matched with the planned values by the above-mentioned elliptical machining for machining the tubes into the elliptical shape.

Next, the resonance frequency is matched with its planned value. Since the half cylindrical tubes 5 are formed smaller in the inner diameter in comparison to its planned value because of the margin for machining from the value, it is machined to achieve the planned electric-field distribution as described above. By the above machining, the inductance L varies and the resonance frequency also varies. Nonetheless, if the resonance frequency is too high, the half cylindrical tubes 5 may be subjected to further machining, that is, the grinding process may be continued so as not to displace the electric-field distribution from the planned values.

Figure 9:
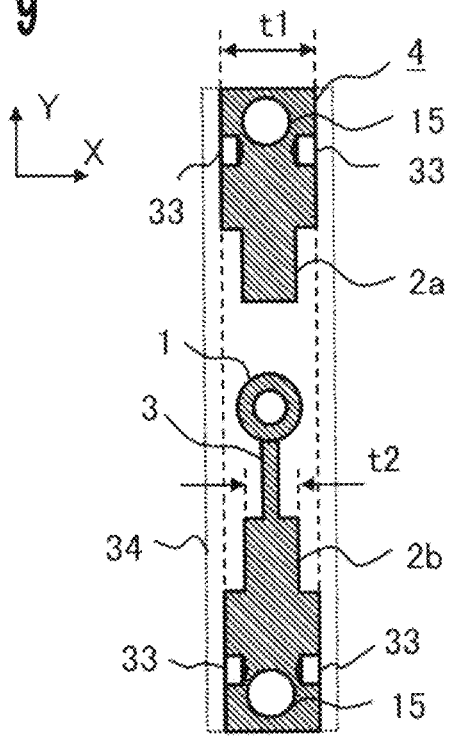
FIG. 9 is a diagram showing the center plate.

In contrast, if the resonance frequency is lower than its planned value when the electric-field distribution is matched with its planned values, the center plate 4 is machined in its plate thickness t1 (a width of the center plate 4 in X-axis direction). FIG. 9 is a diagram showing the center plate of the invention. In order to adjust the resonance frequency, it is preferable that the thickness t1 of the center plate 4 and the thickness t2 of the ridge 2 be different to each other, and the thickness t1 of the center plate 4 be larger than the thickness t2 of the ridge 2. Further, since the inner wall of the machined half cylindrical tube 5 made of aluminum, iron or stainless steel is subjected to copper plating, it is necessary to consider a change in resonance frequency due to the thickness of the copper plating. In the center plate 4, screw holes 33 for attaching the screws 12 are formed. In FIG. 9, a rectangle indicated by a broken line corresponds to the original plate 34 before being machined into the center plate 4.

When the acceleration cavity 6 is operated, heat corresponding to the power consumption generates. Thus, the cooling paths 15 are provided at the fringe portions of the center plate 4. Since the ridges 2, the stem 3 and the drift tube electrodes 1 in the center plate 4 are made integral by a common material, they are well in heat conductivity. Further, in the half cylindrical tube 5 after completion of adjusting the electric field-distribution and resonance frequency, at least one cooling path 19 is formed at its redundant thick-walled portion. By cooling using the cooling path 15 and the cooling path 19, a change in resonance frequency due to heat generation in the acceleration cavity 6 is made smaller. When the resonance frequency is going to vary due to environmental change, it is possible to keep the resonance frequency still constant by actively utilizing the cooling paths 15 and 19 to increase or decrease the chiller temperature.

As described above, according to the drift tube linear accelerator 30 of Embodiment 1, it is possible to adjust the resonance frequency and electric-field distribution of the acceleration cavity 6 without mounting an external tuner thereto. The acceleration cavity 6 having been adjusted in its resonance frequency and electric-field distribution is structurally characterized in that the center plate 4 includes a ridge 2 whose thickness t2 is less than the thickness t1 of the center plate 4, that the inner shape of the half cylindrical tubes 5 is made elliptical with the inner diameter enlarged in the X-axis direction, and that the inner diameter varies in the Z-axis direction. As previously mentioned, in order to enhance the electric field intensity, if the inner diameter of one portion of the acceleration cavity 6, for example, the inner diameter in the incident side of the half cylindrical tubes 5 is enlarged, the electric field intensity in the emitting side is decreased inversely. Thus, the inner diameter in the emitting side of the half cylindrical tubes 5 is also enlarged, so that the inner diameters at the respective positions "z" in the incident side and the emitting side are adjusted to thereby match the electric field intensities in the respective sides with their planned values. Namely, in the structure, the inner diameter r1($z$) of the acceleration cavity 6 is not constant, and may vary in Z-axis direction. In addition, the drift tube linear accelerator 30 of Embodiment 1 is characterized in that no external tuner is mounted, of course, and the port ducts 9 are detachably mounted by screw-fastening.

Once the actual value(s) and the planned value(s) are matched with each other by the above shape-machining process of the half cylindrical tubes 5 and the center plate 4, the center plate 4 is subjected to machining by the NC machine, so that the positions of drift tube electrodes 1 are ensured by the machining accuracy of the NC machine. Thus, according to the drift tube linear accelerator 30 of Embodiment 1, unlike the conventional case where the drift tube electrodes 1 are manually arranged thereby causing an electrode-to-electrode difference which is a variation for every drift tube electrode 1, it becomes possible not to cause the electrode-to-electrode difference. Therefore, the half cylindrical tubes 5 and the center plate 4 can be reproduced without change, so that the second or later accelerator product can be manufactured in lower cost by simply applying the above manufacturing process without change.

According to the drift tube linear accelerator 30 of Embodiment 1, no external tuner is required and thus there is no increase in surface resistance and contact resistance due to the external tuner, resulting in decreased power consumption. Further, since there is no increase in surface resistance and contact resistance due to the external tuner, it is unnecessary to increase the capacity of the high frequency power source. Furthermore, once the drift tube linear accelerator 30 is manufactured, it is unnecessary, when its remanufacturing, to adjust the resonance frequency and the electric-field distribution. This makes it possible to shorten the time period for adjusting the drift tube linear accelerator 30.

By the drift tube linear accelerator 30 of Embodiment 1, since the center plate 4 has the thickness t1 which is more than the thickness t2 of the ridges 2$a$,2$b$, it is possible to broaden the adjustable range of the resonance frequency. As previously described, the resonator (acceleration cavity 6) is grinded for adjusting the electric-field distribution, so that the cross-sectional area S of the acceleration cavity 6 is tend to be enlarged due to such grind-machining. Thus, the resonance frequency becomes adjusted according to the formula (1) toward its decreasing side. Accordingly, with respect to the relation between the thickness t1 of the center plate 4 and the thickness t2 of the ridges, when a machining margin of (t1−t2) is given to the center plate 4, it is possible to broaden the adjustable range of the resonance frequency. Retaining such a margin in the center plate 4 means that the cross-sectional area S of the acceleration cavity 6 has been preliminarily adjusted to its narrower side. Namely, by the presence of the margin, it becomes possible to adjust the resonance frequency toward its increasing side according to the formula (1). As a result, the adjustable range of the resonance frequency can be broadened.

Since, the drift tube linear accelerator 30 of Embodiment 1 is an IH-type linear accelerator, thus having a shortened whole length, it can be machined by an NC machine. Since the drift tube linear accelerator 30 of Embodiment 1 can be machined by a NC machine, positional accuracy of the drift tube electrode 1 is improved, so that the electric-field distribution generated between the drift tube electrodes 1 and the resonance frequency can be finely adjusted. In the drift tube linear accelerator 30 of Embodiment 1, since the vacuum evacuation hole 7 of the vacuum evacuation port 27 is formed with a plurality of slits, it is unnecessary to provide a separate RF mesh. According to the drift tube linear accelerator 30 of Embodiment 1, since the vacuum evacuation hole 7 of the vacuum evacuation port 27 is formed with a plurality of slits without providing a separate RF mesh, there is no increase in surface resistance and contact resistance due to the RF mesh, thereby making it possible to reduce the power consumption in comparison to that with the RF mesh.

As described above, the drift tube linear accelerator 30 of Embodiment 1 is a drift tube linear accelerator comprising the drift tube electrodes 1 arranged in the acceleration cavity 6, for accelerating charged particles along the beam-acceleration center axis 20 by an electric field generated between one of the drift tube electrodes 1 and another of the drift tube electrodes 1 adjacent thereto, which is characterized in that, the acceleration cavity 6 is configured with the center plate 4 and a pair of half cylindrical tubes 5*a*,5*b*; the center plate 4 comprises the ridge 2, the stems 3 and the drift tube electrodes 1, each stem 3 connecting the ridge 2 and the drift tube electrode 1, which are made from a common block; and the acceleration cavity 6 is configured, as seen in cross section perpendicular to the beam-acceleration center axis 20, whose inner diameter d1 in X-direction that is perpendicular to the central axis in planar direction 21 in which the stem 3 of the center plate 4 extends and that is passing through the beam-acceleration center axis 20, is longer than whose inner diameter d2 in Y-direction parallel to said central axis in planar direction 21. Thus, by forming the acceleration cavity 6 with the center plate 4 and the pair of half cylindrical tubes 5*a*,5*b*, and by machining the pair of half cylindrical tubes 5*a*,5*b* so that, as seen in cross section perpendicular to the beam-acceleration center axis 20 in the acceleration cavity 6, the inner diameter d1 in X-direction is longer that of the inner diameter d2 in Y-direction, it is possible to adjust the resonance frequency and the electric-field distribution of the acceleration cavity 6, and therefore, although being an IH-type, it is possible to achieve power saving by not providing the external tuner.

Embodiment 2

Figure 10:
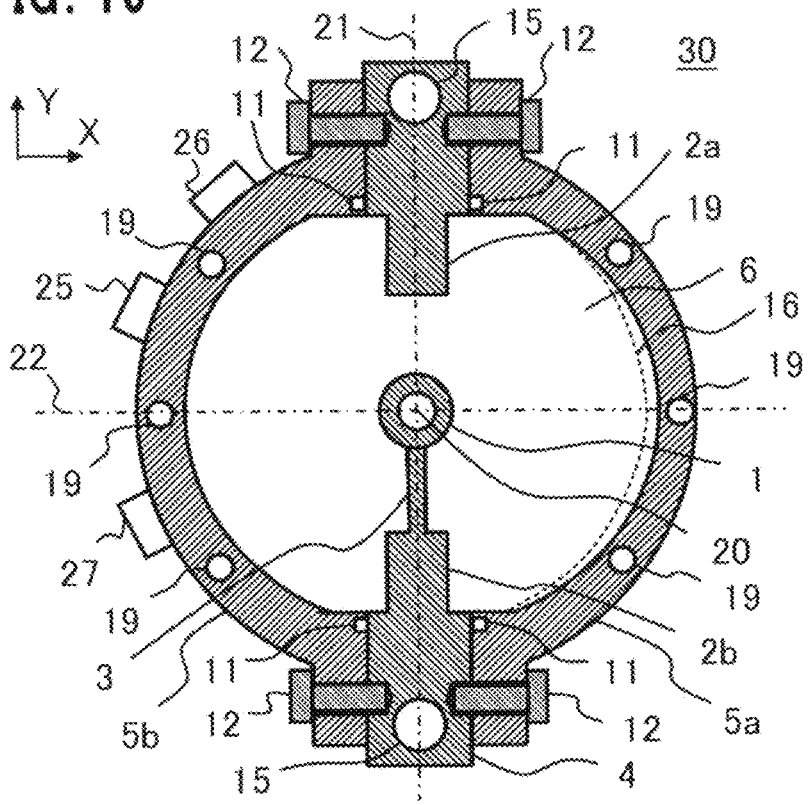
FIG. 10 is a transverse cross-sectional view of a drift tube linear accelerator according to Embodiment 2 of the invention.

FIG. 10 is a transverse cross-sectional view of a drift tube linear accelerator according to Embodiment 2 of the invention. In Embodiment 1, with respect to the pair of half cylindrical tubes 5*a*, 5*b*, the respective right and left half cylindrical tubes 5*a*, 5*b* are machined in the inner diameter in X-axis direction for matching the resonance frequency and the electric-field distribution with their planned values; however, here, only either one of the half cylindrical tubes 5 may be machined in the inner diameter in X-axis direction. Shown in FIG. 10 is an example in which the half cylindrical tube 5*b* includes at least one of each of the power supply port 25, the power measurement port 26 and the vacuum evacuation port 27, and only the half cylindrical tube 5*a* is machined in the inner diameter in X-axis direction. With this example, the machining for adjusting the resonance frequency and the electric-field distribution, is applied only to the one half cylindrical tube 5*a*, which results in a shortened machining time for the pair of half cylindrical tubes 5*a*, 5*b*. In this instance, the machining time for the pair of half cylindrical tubes 5*a*, 5*b* can be shortened by up to half. Further, according to the above example, it is possible to concurrently perform the port-machining for providing the power supply port 25, the power measurement port 26 and the vacuum evacuation port 27, and the adjustment-machining for matching of the resonance frequency and the electric-field distribution. This makes the total time for the port-machining and the adjustment-machining to be shortened.

It is noted that the adjustment-machining for matching of the resonance frequency and the electric-field distribution may also be applied to the half cylindrical tube 5*b* on which the power supply port 25, the power measurement port 26 and the vacuum evacuation port 27 are formed.

Embodiment 3

Figure 11:
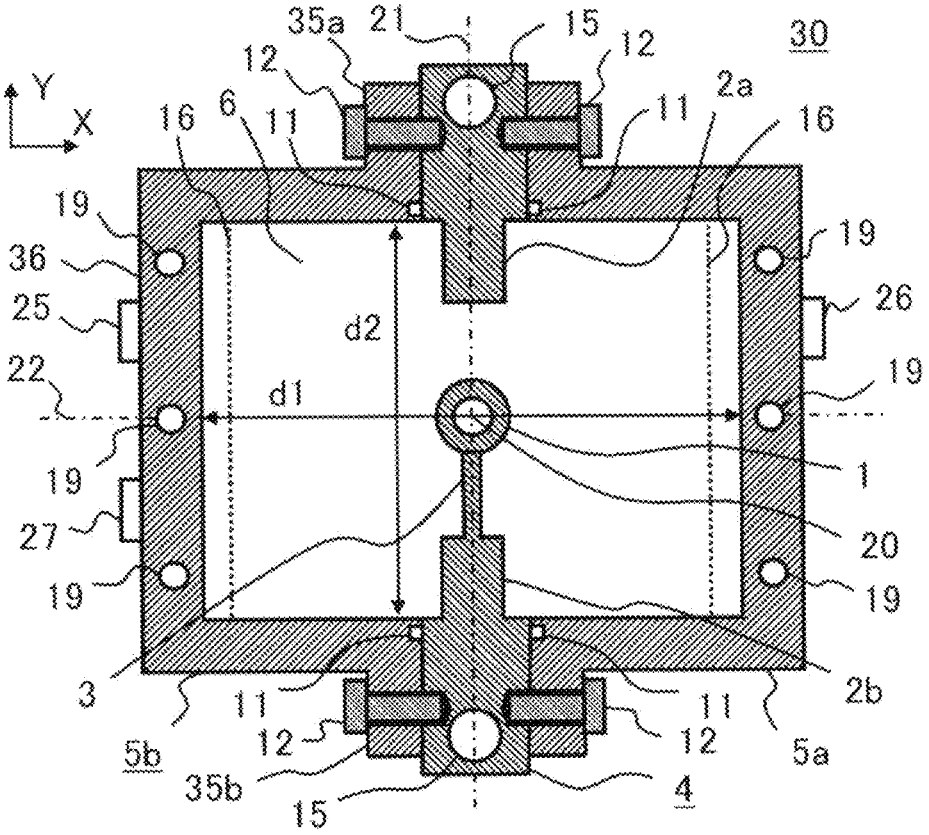
FIG. 11 is a transverse cross-sectional view of a drift tube linear accelerator according to Embodiment 3 of the invention.

In Embodiment 1, a case is described where, as seen in cross section perpendicular to the beam-acceleration center axis 20, the half cylindrical tubes 5*a*, 5*b* each include inner wall and outer wall whose shapes are arc-like; however, the shapes may be polygonal resulted from machining to modify the inner diameter around the beam-acceleration center axis 20 other than the inner diameter near the Y-axis. FIG. 11 is a transverse cross-sectional view of a drift tube linear accelerator according to Embodiment 3 of the invention. Shown in FIG. 11 is an example in which the half cylindrical tubes 5*a*, 5*b* are fabricated so that the acceleration cavity 6 becomes rectangle in shape. Specifically, in this example, the acceleration cavity 6 is oblong in shape in which the distance from the beam-acceleration center axis 20 to the half cylindrical tube 5*a* or 5*b* is long in the direction perpendicular to the stem 3. Although the resistance against the current flowing through the inner wall of the acceleration cavity 6 is slightly increased due to the polygonal structure, the machining into the shape is easy. According to the drift tube linear accelerator 30 according to Embodiment 3, the ease of fabrication is enhanced for the thus-shaped acceleration cavity 6, thereby lowering the manufacturing cost of the drift tube linear accelerator 30.

Embodiment 4

Figure 12:
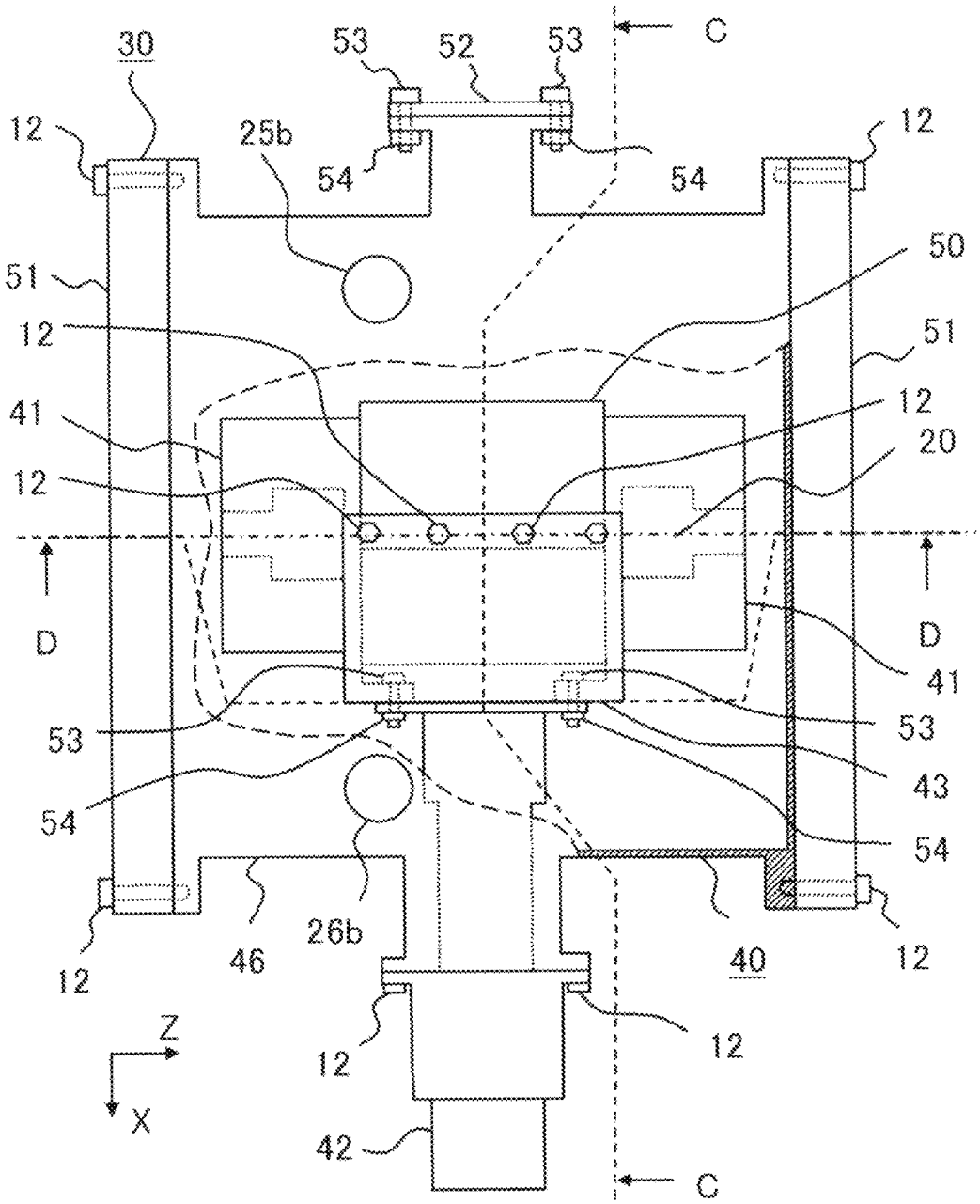
FIG. 12 is a configuration diagram of a drift tube linear accelerator according to Embodiment 4 of the invention.
Figure 13:
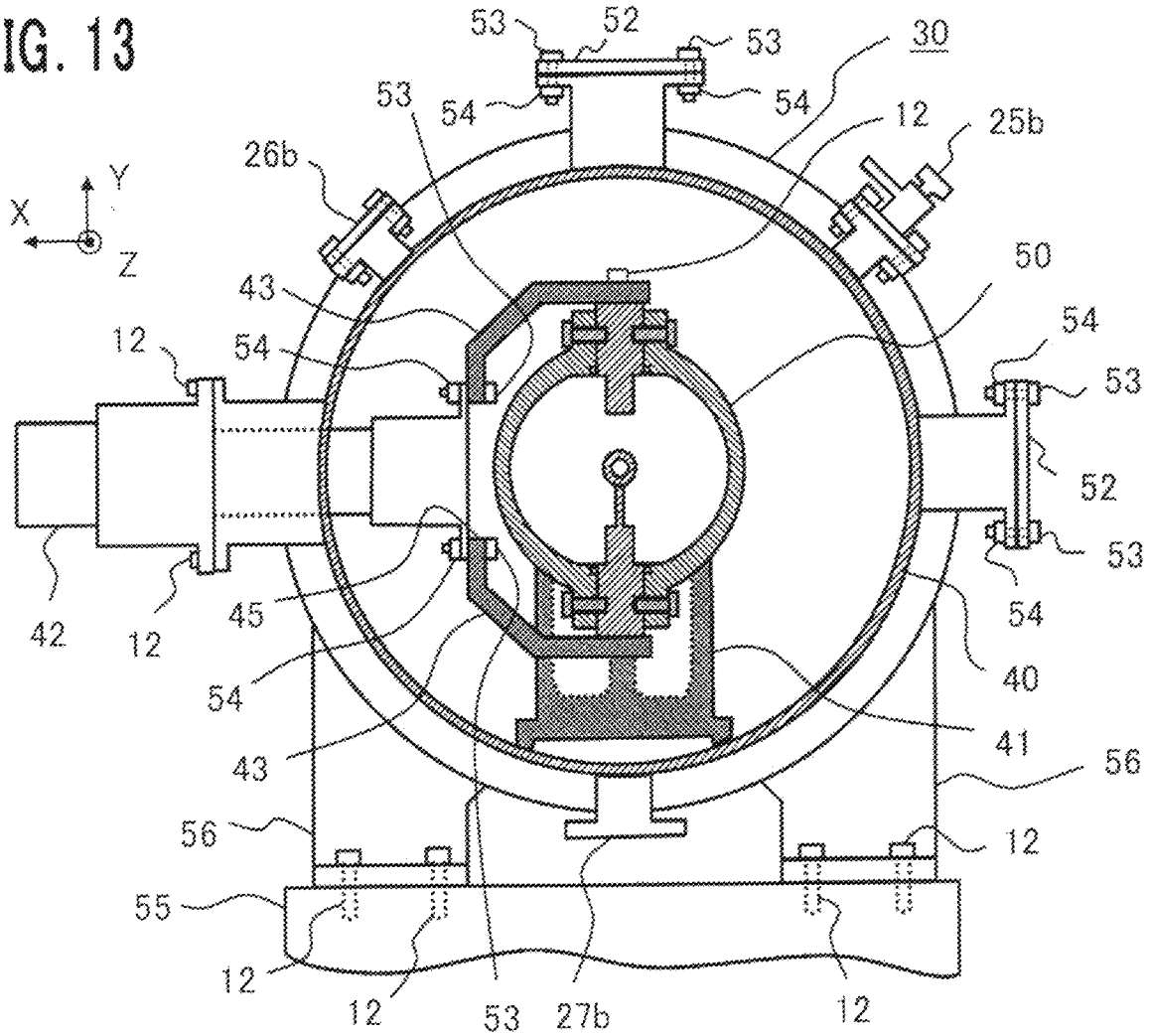
FIG. 13 is a transverse cross-sectional view taken along C-C line in FIG. 12.
Figure 14:
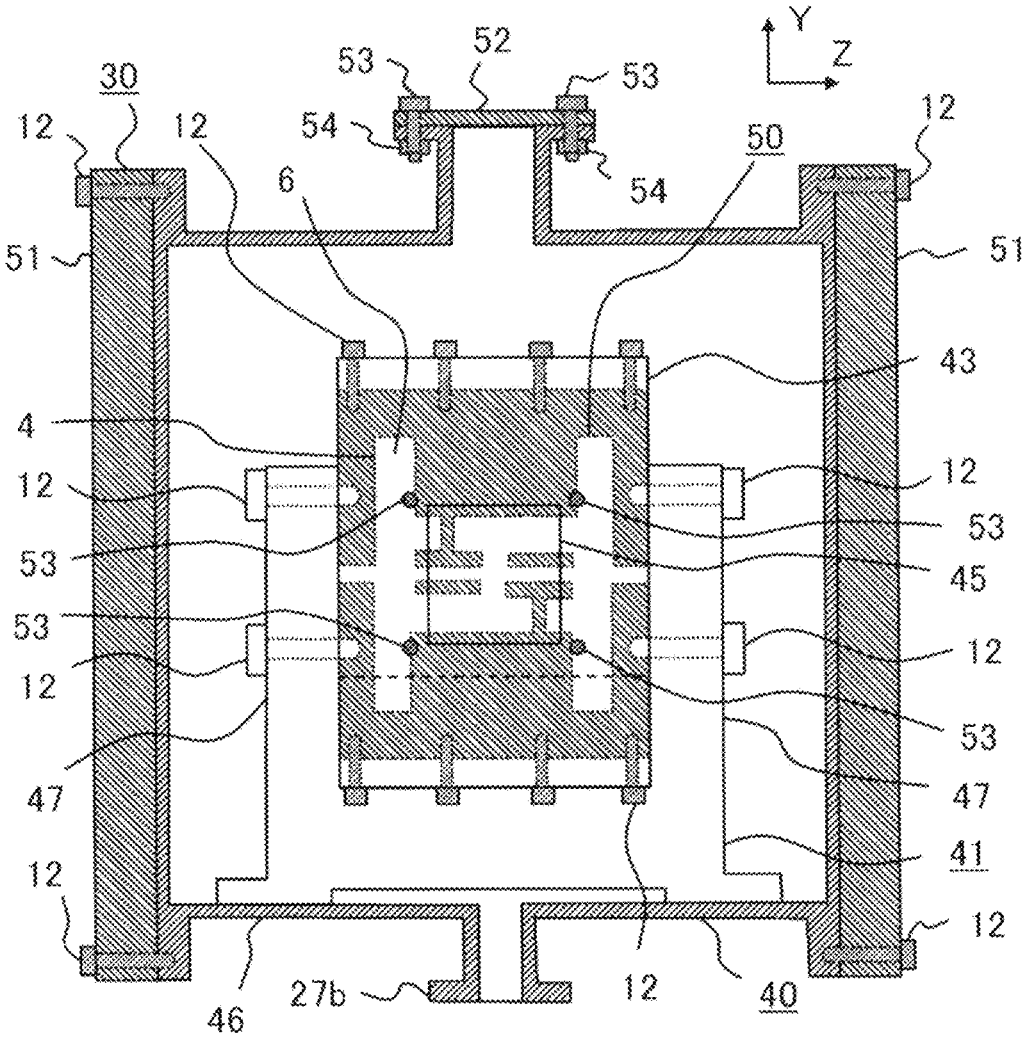
FIG. 14 is a longitudinal cross-sectional view taken along D-D line in FIG. 12.
Figure 15:
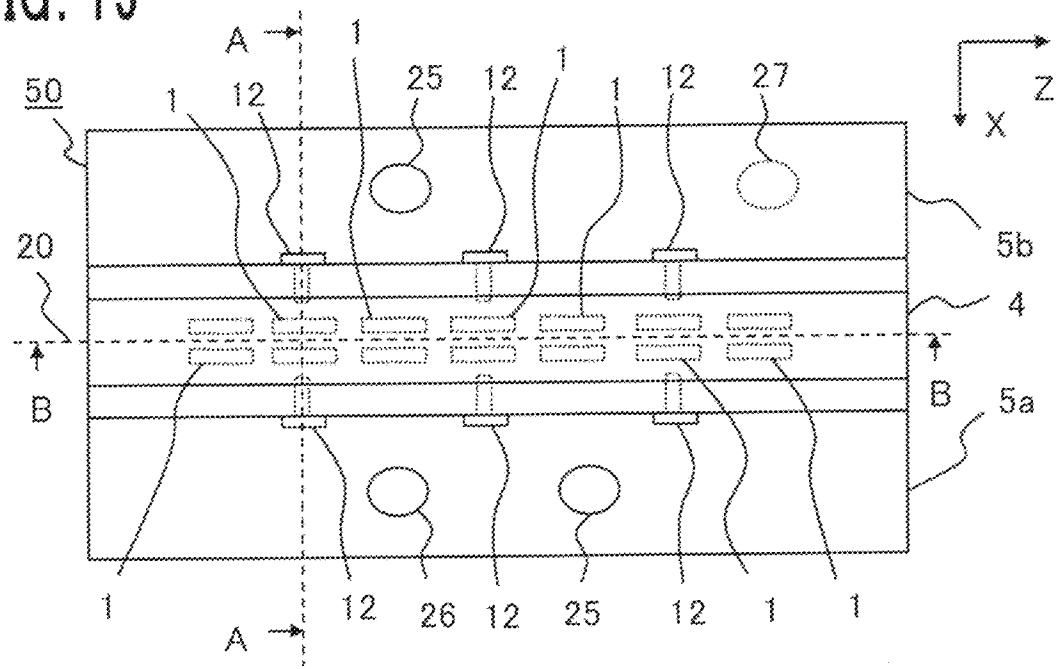
FIG. 15 is a configuration diagram of a drift-tube-linear-accelerator basic portion according to Embodiment 4 of the invention.
Figure 16:
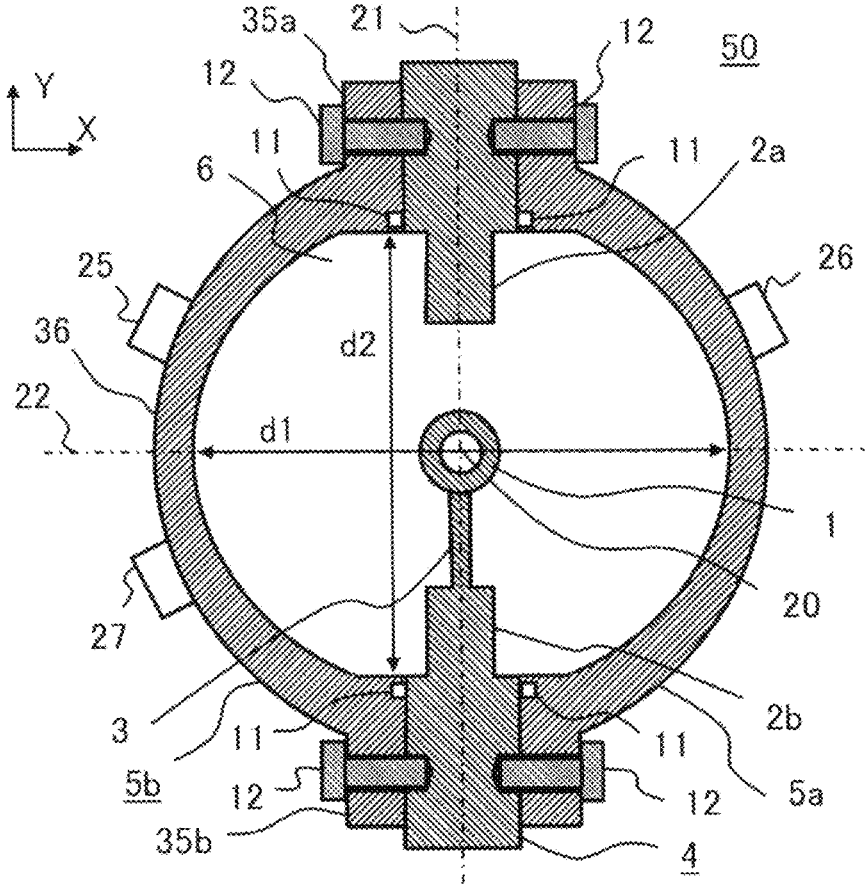
FIG. 16 is a transverse cross-sectional view taken along A-A line in FIG. 15.
Figure 17:
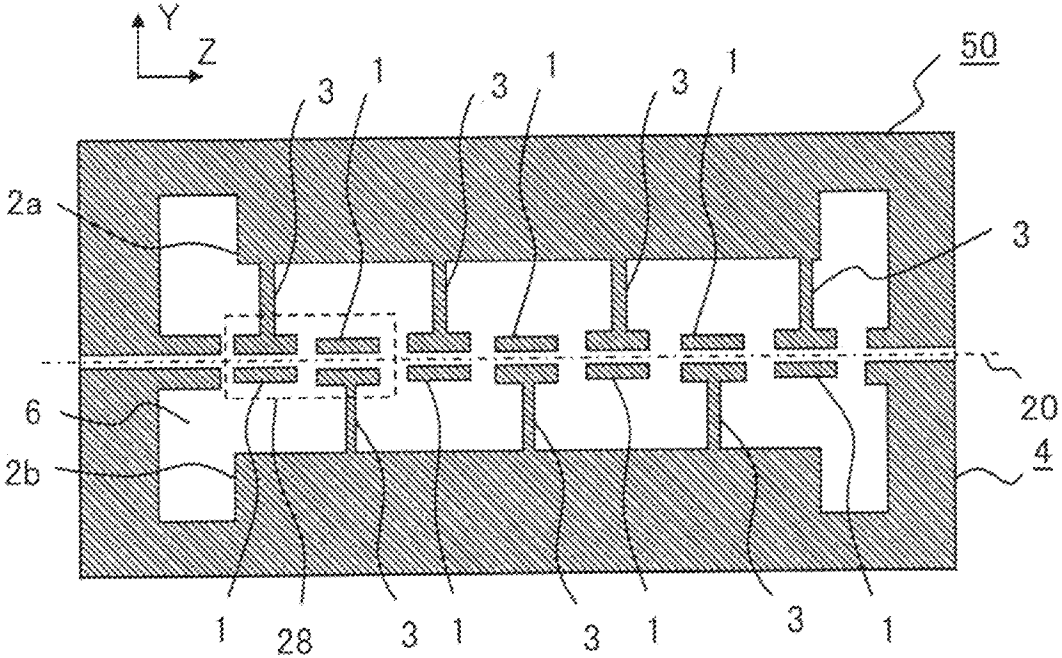
FIG. 17 is a longitudinal cross-sectional view taken along B-B line in FIG. 15.

In Embodiment 4, a case is described where the drift tube electrodes 1 and the acceleration cavity 6 are cooled under a lower temperature than that of a conventional cooling, such as water-cooling or the like. The cooling temperature in Embodiment 4 is from a temperature lower than 0° C. to 0 K (kelvin), and a state placed in such a temperature range is referred to as a "super-cold state". FIG. 12 is a configuration diagram of a drift tube linear accelerator according to Embodiment 4 of the invention. FIG. 13 is a transverse cross-sectional view taken along C-C line in FIG. 12. FIG. 14 is a longitudinal cross-sectional view taken along D-D line in FIG. 12. FIG. 15 is a configuration diagram of a drift-tube-linear-accelerator basic portion of the according to Embodiment 4 of the invention. FIG. 16 is a transverse cross-sectional view taken along A-A line in FIG. 15. FIG. 17 is a longitudinal cross-sectional view taken along B-B line in FIG. 15. Note that, in FIG. 12, the diagram is partially cut away so that the drift-tube-linear-accelerator basic portion 50 can be seen. In FIG. 14, for ease of comprehension, each cross-section in Y-Z plane including the beam-acceleration center axis 20 is shown for the center plate 4, a heat-insulating support body 46 and some of the screws 12.

The drift tube linear accelerator 30 of Embodiment 4 includes, the-drift-tube-linear-accelerator basic portion 50; a heat-insulating support 40 for supporting the drift-tube-linear-accelerator basic portion 50 and storing the drift-tube-linear-accelerator basic portion 50 in sealed state; a low-temperature retaining device 41 for retaining the drift-tube-linear-accelerator basic portion 50 in low temperature; a cooling device 42 for cooling the drift-tube-linear-accelerator basic portion 50 to a super-cold state where the drift tube electrode 1 and the half cylindrical tube 5 as a configuration unit of the acceleration cavity 6 make changes in their material properties; and a heat-conducting member 43 for connecting the cooling device 42 with the drift-tube-linear-accelerator basic portion 50. The heat-insulating support 40 serves to store therein the drift-tube-linear-accelerator basic portion 50 in sealed state, and to support the drift-tube-linear-accelerator basic portion 50 against its weight and the force generated by the magnetic field. The heat-insulating support 40 includes the heat-insulating support body 46, sealing plates 51 for sealing openings of the heat-insulating support body 46 facing in Z-direction, and a sealing plate 52 for sealing an opening formed on the periphery of the heat-insulating support body 46. The sealing plates 51 are fixed by screws 12 to the heat-insulating support body 46, and the sealing plate 52 is fixed by bolts 53 and nuts 54 to the heat-insulating support body 46. The cooling device 42 is inserted in another opening formed on the periphery of the heat-insulating support body 46 and fixed by screws 12 to the heat-insulating support body 46. The heat-insulating support 40 includes support portions 56 therefor which are fastened by screws 12 to a mounting pedestal 55. Note that the sealing plates 51, 52 and the like are fastened to the heat-insulating support 40 through O-rings for vacuum sealing (not shown), thereby making it possible to vacuumize the inside of the support.

The drift-tube-linear-accelerator basic portion 50 is configured as similarly to the drift tube linear accelerators 30 described in Embodiments 1 to 3. Here, description is firstly made for a case where no cooling paths 15,19 is formed in the center plate and the half cylindrical tubes 5 of the drift-tube-linear-accelerator basic portion 50. In comparison to the drift tube linear accelerators 30 of Embodiments 1 to 3, the drift-tube-linear-accelerator basic portion 50 shown in FIGS. 15 to 17 differs in the lack of the cooling paths 15, 19, but is the same in other configuration, so that repetitive description thereof is omitted here.

The heat-conducting member 43 is made of a highly heat-conductive material, which connects the center plate 4 of the drift-tube-linear-accelerator basic portion 50 with the cooling device 42 to allow transfer of heat therebetween. The heat-conducting member 43 shown in FIGS. 12 to 14 is an example configured as a bent plate that is bent so as to clamp both ends in Y-direction of the center plate 4. As shown in FIG. 14, the heat-conducting member 43 is fixed to the center plate 4 by screws 12. An opening 45 is formed in the heat-conducting member 43, and the cooling device 42 and the heat-conducting member 43 are joined together by bolts 53 and nuts 54 at around the opening 45. In Embodiment 4, the heat-conducting member 43 is made of copper.

On the heat-insulating support body 46 of the heat-insulating support 40, a power supply port 25*b*, a power measurement port 26*b* and a vacuum evacuation port 27*b* are formed. The power supply port 25*b*, the power measurement port 26*b* and the vacuum evacuation port 27*b* may be formed at the positions corresponding to the positions of the power supply port 25, the power measurement port 26 and the vacuum evacuation port 27 of the drift-tube-linear-accelerator basic portion 50, that is, at the positions which are placed on the periphery area and in the lines extending from the respective positions of the power supply port 25, the power measurement port 26 and the vacuum evacuation port 27 in radial directions from the beam-acceleration center axis 20. It should be noted that the vacuum evacuation port 27*b* is not necessarily formed at the position corresponding to the vacuum evacuation port 27. In FIGS. 12 to 14, the vacuum evacuation port 27*b* is formed as displaced from the position corresponding to the vacuum evacuation port 27. In FIGS. 12 to 14, the power supply port 25*b* and the power measurement port 26*b* are arranged at the positions which are placed on the periphery area and in the lines extending from the respective positions of the power supply port 25, the power measurement port 26 in radial directions from the beam-acceleration center axis 20.

The drift-tube-linear-accelerator basic portion 50 is covered at its lower portion with the low-temperature retaining device 41, and is fixed at its both ends in Z-direction to fixing portions 47 of the low-temperature retaining device 41 by screws 12. In FIGS. 12 to 14, a case is illustrated where the fixing portions 47 are arranged as sandwiching the both ends in Z-direction of the drift-tube-linear-accelerator basic portion 50.

In the drift tube linear accelerator 30 of Embodiment 4, the inside of the heat-insulating support 40 is placed in a vacuum state by way of the vacuum evacuation port 27*b*. Further, in the drift tube linear accelerator 30, the insides of the drift-tube-linear-accelerator basic portion 50 and the low-temperature retaining device 41 are placed in a vacuum state by way of the vacuum evacuation port 27*b* and the vacuum evacuation port 27. The insides of the drift-tube-linear-accelerator basic portion 50 and the low-temperature retaining device 41 are connected to each other through a communication hole (not shown).

The drift tube linear accelerator 30, after its inside was placed in the vacuum state, is cooled by the cooling device 42 through the heat-conducting member 43 to a super-cold state where the drift tube electrode 1 and the half cylindrical tube 5 make changes in their material properties. Thereafter, power for accelerating the beam is supplied to the acceleration cavity 6 through the power supply port 25 and the power supply port 25*b*, so that an accelerating electric-field for accelerating the beam is generated between the drift tube electrodes 1 to thereby accelerate the beam. An amount of power to produce the accelerating electric-field for accelerating the beam, is comprised of the power consumption by the drift tube electrodes 1 and the acceleration cavity 6 plus the power for beam-loading. The drift tube electrodes 1 and the half cylindrical tubes 5 are cooled by the cooling device 42 to the super-cold state where they make changes in their material properties, and maintained in the cooled state (the super-cold state) by the low-temperature retaining device 41.

According to the drift tube linear accelerator 30 of Embodiment 4, the drift tube electrodes 1 and the half cylindrical tubes 5 are maintained in the cooled state (the super-cold state) as aforementioned, so that the surface resistances of the drift tube electrodes 1 and the acceleration cavity 6 (inner surface of the half cylindrical tube 5) are decreased, thus making it possible to reduce the amount of power consumption by the drift tube electrodes 1 and the acceleration cavity 6 in comparison to the case of cooling using a cooling water.

Figure 18:
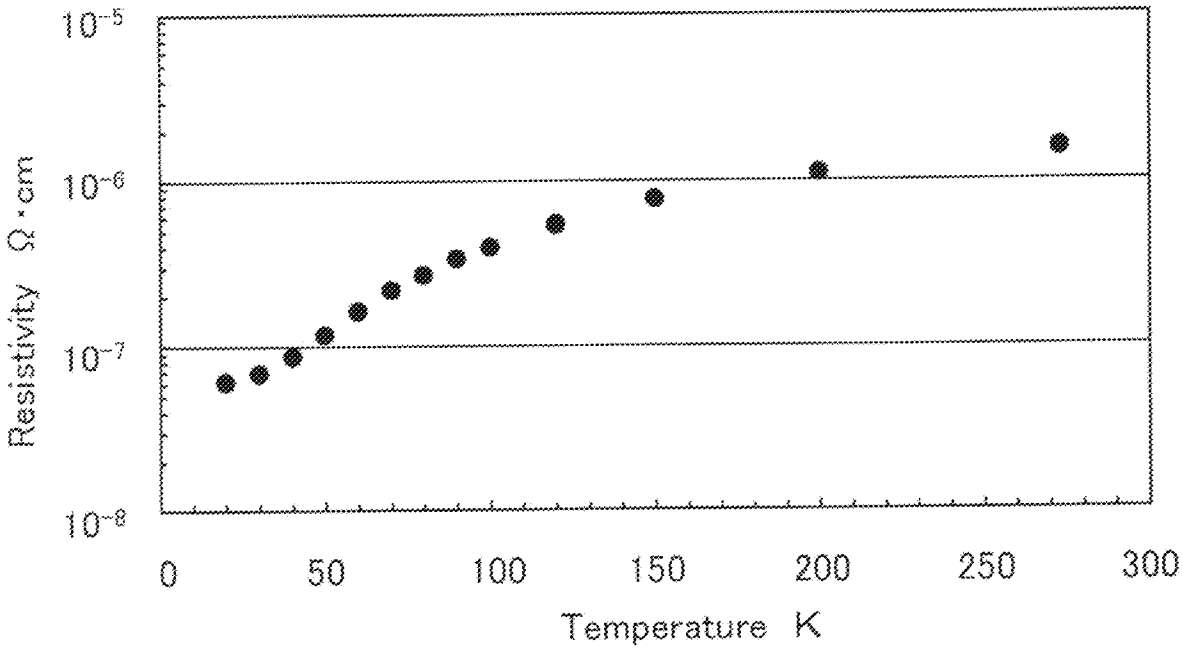
FIG. 18 is a graph showing a thermal dependency of resistivity of copper.
Figure 19:
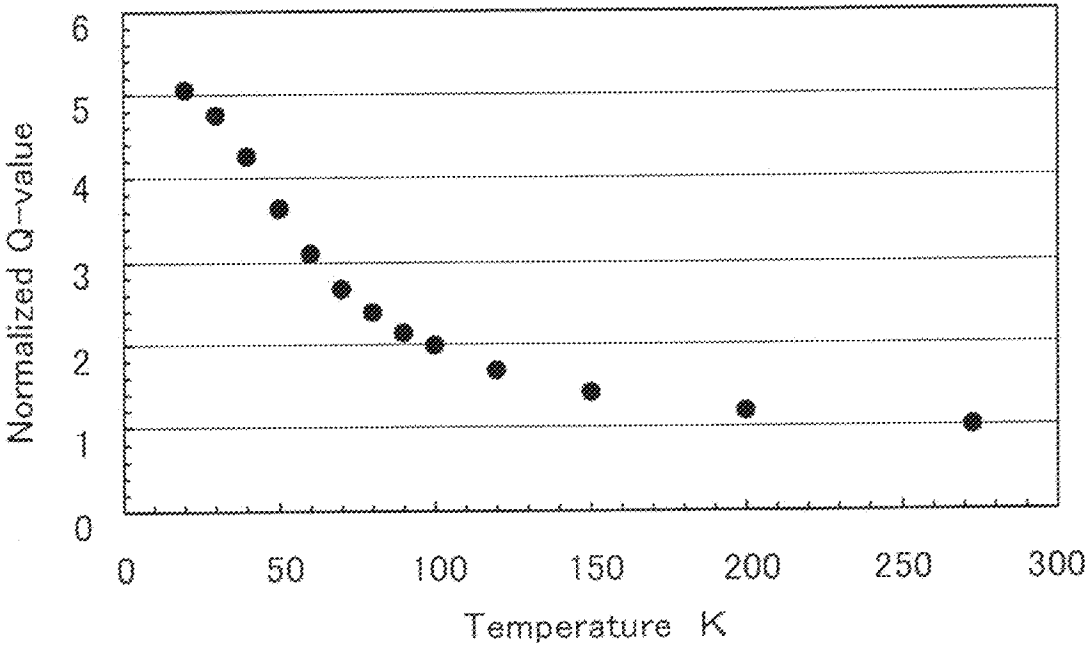
FIG. 19 is a graph showing a thermal dependency of a normalized Q-value.

Here, the super-cold state in Embodiment 4 will be defined. Since the amount of power consumption is inversely proportional relative to a Q-value indicating a property of the cavity, the amount of power consumption is reduced as the Q-value becomes higher. Between the Q-value and the resistivity of the material of the half cylindrical tube 5 and the center plate 4 constituting the acceleration cavity 6, there is an inverse square-root relationship. For example, a resistivity of copper versus temperature is shown in FIG. 18. FIG. 19 shows a relationship between the Q-value normalized assuming that the normal temperature (273K) is "1", and a temperature. In FIG. 18, the resistivity (Ω·cm) is shown on the ordinate, and in FIG. 19, the normalized Q-value is shown on the ordinate. In FIGS. 18 and 19, the temperature (K) is shown on the abscissas. From FIG. 19, it can be seen that, in order to reduce, for example, to half the amount of power consumption by the material constituting the acceleration cavity 6, that is, in order to double the Q-value, it is suited to cool from 273 K to lower the temperature of the acceleration cavity 6 (the drift-tube-linear-accelerator basic portion 50) to be around 100 K. Accordingly, the "cooling" to the super-cold state in Embodiment 4 is different to a usual cooling, such as water-cooling etc., for generally suppressing heat generated in the acceleration cavity 6, but means a cooling to a temperature from at least 0° C. or less to 0 K. The state in such a temperature range is defined as the super-cold state.

It is noted that, for avoiding the beam axis from vibrating due to transmission of vibration of the cooling device 42 to the drift tube electrodes 1 and the acceleration cavity 6, a vibration damping member or a vibration damping structure may preferably be included in a joining region between the cooling device 42 and the heat-conducting member 43.

Further, as to the heat-conducting member 43, it is preferable to apply a both-side arrangement in which the heat-conducting member 43 is arranged in each of both sides of the acceleration cavity 6, other than the cantilever arrangement in which the heat-conducting member 43 is arranged in one side of the acceleration cavity 6 as shown in FIGS. 12 to 15. When the both-side arrangement of the heat-conducting member 43 is applied, it is possible to more mitigate than the cantilever arrangement, the deviation of the beam axis due to temperature difference between the ordinary-temperature state and the super-cold state.

Although a case is described in Embodiment 4 where the drift tube electrodes 1 and the acceleration cavity 6 are cooled using the cooling device 42 and the heat-conducting member 43, the drift tube electrodes 1 and the acceleration cavity 6 may be cooled, not using the cooling device 42 and the heat-conducting member 43, but directly using liquid helium or liquid nitrogen, to the super-cold state where they make changes in their material properties. In this instance, it is suited to configure the drift-tube-linear-accelerator basic portion 50 similarly to, for example, the drift tube linear accelerators 30 of Embodiments 1 to 3. That is, it is suited to form the cooling path 15 and the cooling path 19 in the center plate 4 and the half cylindrical tubes 5 of the drift-tube-linear-accelerator basic portion 50, and to flow liquid helium or liquid nitrogen in the cooling path 15 and the cooling path 19.

Embodiment 5

Figure 20:
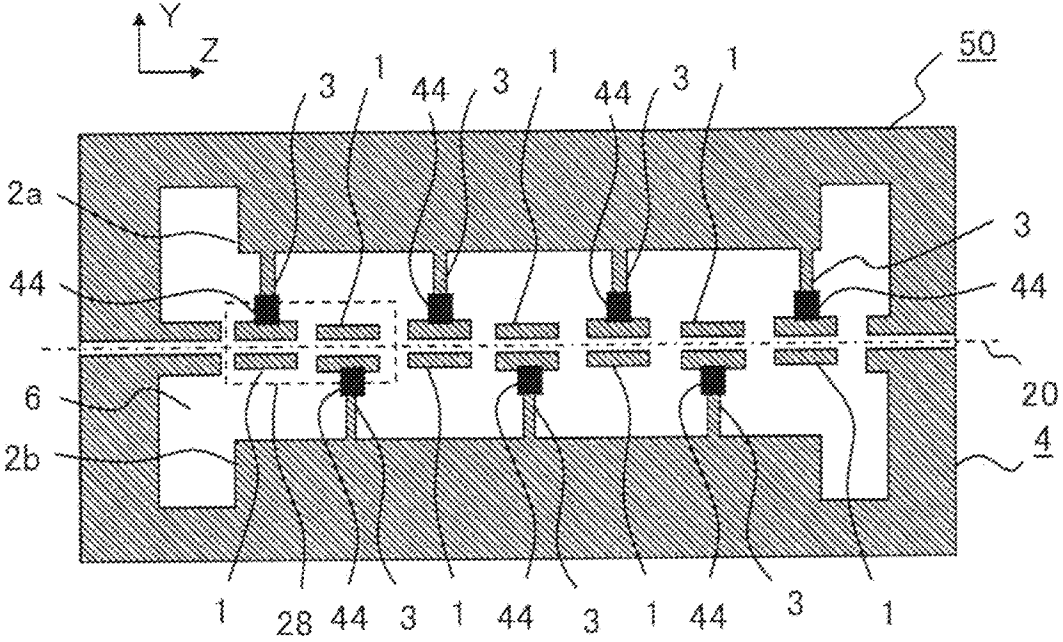
FIG. 20 is a longitudinal cross-sectional view of a main-part of a drift tube linear accelerator according to Embodiment 5 of the invention.

FIG. 20 is a longitudinal cross-sectional view of a main-part of a drift tube linear accelerator according to Embodiment 5 of the invention. In Embodiment 5, in addition to the configuration of Embodiment 4, a superconducting wire 44 is provided on the stem 3 of higher current-density. Specifically, the drift tube linear accelerator 30 of Embodiment 5 is resulted from attaching the superconducting wire 44 in a form of tape on a surface of the stem 3 of the center plate 4 in the drift tube linear accelerator 30 of Embodiment 4. The superconducting wire 44 is, for example, an yttrium-family superconductor wire.

In the drift tube linear accelerator 30 of Embodiment 5, the inside of the heat-insulating support 40 is placed in a vacuum state, as similar to Embodiment 4, through the vacuum evacuation port 27*b*. Further, in the drift tube linear accelerator 30, the insides of the drift-tube-linear-accelerator basic portion 50 and the low-temperature retaining device 41 are placed in a vacuum state through the vacuum evacuation port 27*b* and the vacuum evacuation port 27.

After the drift tube linear accelerator 30 is placed in the vacuum state, the drift tube electrodes 1 and the half cylindrical tubes 5 are cooled by the cooling device 42 through the heat-conducting member 43 to a super-cold state where the superconducting wire 44 exhibits a superconductive property. Thereafter, power for accelerating the beam is supplied to the acceleration cavity 6 through the power supply port 25 and the power supply port 25*b*, so that an accelerating electric-field for accelerating the beam is generated between the drift tube electrodes 1 to thereby accelerate the beam. An amount of power to produce the accelerating electric-field for accelerating the beam, is comprised of the power consumption by the drift tube electrodes 1 and the acceleration cavity 6 plus the power for beam-loading. The drift tube electrodes 1 and the half cylindrical tubes 5 are cooled by the cooling device 42 to the super-cold state where they make changes in their material properties, and maintained in the cooled state (the super-cold state) by the low-temperature retaining device 41.

According to the drift tube linear accelerator 30 of Embodiment 5, the drift tube electrodes 1 and the acceleration cavity 6 are maintained in the cooled state (the super-cold state) as aforementioned, so that the surface resistances of the drift tube electrodes 1 and the acceleration cavity 6 (inner surface of the half cylindrical tube 5) are decreased, and in addition, the surface resistance of higher current-density area of the stem 3 connected to the drift tube electrode 1 is decreased due to the superconductive property of the superconducting wire 44. Thus, it becomes possible to reduce the amount of power consumption by the drift tube electrodes 1 and the acceleration cavity 6 in comparison to Embodiment 4.

Shown here is a case where the superconducting wire 44 is attached only on the higher current-density area of the stem 3; however, the superconducting wire 44 may be attached on a higher current-density area of the acceleration cavity 6 (the inner surface of the half cylindrical tube 5 and/or the surface of the center plate 4) or on a whole area thereof. Further, although an yttrium-family superconductor wire is used as an example of the superconducting wire 44, another superconducting material may be used.

Further, the description in Embodiments 1 to 5 is made for the case of IH-type linear accelerator; however, even in the case of Alvarez-type accelerator, it is necessary to adjust the resonance frequency and accelerating electric-field distribution of the acceleration cavity 6, and thus it is possible to finely adjust them by applying the present invention without providing the external tuner. Since the Alvarez-type accelerator is longer in whole length than the IH-type linear accelerator, it is suited to be manufactured by an NC machine using the half cylindrical tubes 5 divided into sections of a machinable length. It should be noted that any combination of the respective embodiments, and any appropriate modification or omission of configuration element in the respective embodiments may be made in the present invention without departing from the scope of the invention.

What is claimed is:

1. A drift tube linear accelerator comprising drift tube electrodes arranged in an acceleration cavity, for accelerating charged particles along a beam-acceleration center axis by an electric field generated between one of the drift tube electrode and another of the drift tube electrodes adjacent thereto, wherein:

the acceleration cavity is configured with a center plate and a pair of half cylindrical tubes;

the center plate comprises a ridge, stems and the drift tube electrodes, each stem connecting the ridge and the drift tube electrode, which are made from a common block; and the acceleration cavity is configured, as seen in cross section perpendicular to the beam-acceleration center axis, whose inner diameter in X-direction that is perpendicular to a central axis in planar direction in which the stem of the center plate extends and that is passing through the beam-acceleration center axis, is longer than whose inner diameter in Y-direction parallel to said central axis in planar direction.

2. The drift tube linear accelerator of claim 1, wherein the half cylindrical tube includes two joining portions to be joined to the center plate and a body portion connecting the two joining portions, and, as seen in cross section perpendicular to the beam-acceleration center axis, an inner wall of the body portion is arc-like in shape.

3. The drift tube linear accelerator of claim 2, wherein, as seen in cross section perpendicular to the beam-acceleration center axis, each half cylindrical tube of said pair of half cylindrical tubes includes the body portion whose inner wall is ellipse in shape, and in the ellipse in shape, a distance on a central axis in plate-thickness direction of the center plate, that is perpendicular to the central axis in planar direction of the center plate and that is passing through the beam-acceleration center axis, from the beam-acceleration center axis to the body portion of the half cylindrical tube, is longer than a distance from the beam-acceleration center axis to a boundary between the joining portion and the body portion of the half cylindrical tube.

4. The drift tube linear accelerator of claim 2, wherein, as seen in cross section perpendicular to the beam-acceleration center axis, one half cylindrical tube of said pair of half cylindrical tubes includes the body portion whose inner wall is ellipse in shape, and in the ellipse in shape, a distance on a central axis in plate-thickness direction of the center plate, that is perpendicular to said central axis in planar direction of the center plate and that is passing through the beam-acceleration center axis, from the beam-acceleration center axis to the body portion of the half cylindrical tube, is longer than a distance from the beam-acceleration center axis to a boundary between the joining portion and the body portion of the half cylindrical tube.

5. The drift tube linear accelerator of claim 1, wherein the acceleration cavity is polygonal in cross sectional shape perpendicular to the beam-acceleration center axis.

6. The drift tube linear accelerator of claim 5, wherein the acceleration cavity is oblong in cross sectional shape perpendicular to the beam-acceleration center axis.

7. The drift tube linear accelerator of claim 1, wherein the center plate has a maximum wall thickness which is larger than the wall thickness of the ridge.

8. The drift tube linear accelerator of claim 1, further comprising at least one of each of a power supply port, a power measurement port and a vacuum evacuation port which are formed on only one half cylindrical tube of said pair of half cylindrical tubes.

9. The drift tube linear accelerator of claim 4, further comprising at least one of each of a power supply port, a power measurement port and a vacuum evacuation port which are formed on only one half cylindrical tube of said pair of half cylindrical tubes, said only one half cylinder tube including the body portion whose inner wall is not ellipse in shape as seen in cross section perpendicular to the beam-acceleration center axis.

10. The drift tube linear accelerator of claim 8, wherein said one half cylindrical tube includes a vacuum evacuation hole formed by a plurality of slits, at a portion where the vacuum evacuation port is to be formed.

11. The drift tube linear accelerator of claim 1, which is an IH-type linear accelerator.

12. The drift tube linear accelerator of claim 1, further comprising: a heat-insulating support for supporting the acceleration cavity and storing the acceleration cavity in sealed state; a low-temperature retaining device for retaining the acceleration cavity in low temperature; a cooling device for cooling the acceleration cavity to at least 0° C. or less; and a heat-conducting member for connecting the cooling device and the acceleration cavity.

13. The drift tube linear accelerator of claim 12, further comprising a superconducting wire on a surface of the stem connected with the drift tube electrodes.

14. The drift tube linear accelerator of claim 12, further comprising a superconducting wire in the acceleration cavity.

15. The drift tube linear accelerator of claim 13, further comprising a superconducting wire in the acceleration cavity.

16. The drift tube linear accelerator of claim 13, wherein the superconducting wire is an yttrium-family superconductor wire.

17. The drift tube linear accelerator of claim 14, wherein the superconducting wire is an yttrium-family superconductor wire.

18. The drift tube linear accelerator of claim 15, wherein the superconducting wire is an yttrium-family superconductor wire.

* * * * *